US007082636B1

(12) United States Patent
Rinard et al.

(10) Patent No.: US 7,082,636 B1
(45) Date of Patent: Aug. 1, 2006

(54) BLADED SPOKE WRENCH

(75) Inventors: Damon Rinard, Monona, WI (US); David Blomme, Madison, WI (US); Jeffrey Bogstad, Waterloo, WI (US)

(73) Assignee: Trek Bicycle Corporation, Waterloo, WI (US)

( * ) Notice: Subject to any disclaimer, the term of this patent is extended or adjusted under 35 U.S.C. 154(b) by 0 days.

(21) Appl. No.: 11/077,018

(22) Filed: Mar. 10, 2005

(51) Int. Cl.
*B25B 13/00* (2006.01)
*B25B 23/16* (2006.01)

(52) U.S. Cl. ..... 7/138; 7/100; 7/165; 81/177.4

(58) Field of Classification Search ..... 7/138, 7/100, 165; 81/177.4, 438, 439, 437
See application file for complete search history.

(56) References Cited

U.S. PATENT DOCUMENTS

| | | | | | |
|---|---|---|---|---|---|
| 188,243 | A | | 3/1877 | Gold | |
| 449,000 | A | | 3/1891 | Sehaap | |
| 520,562 | A | | 5/1894 | Dudly | |
| 564,625 | A | | 7/1896 | Kelsea | |
| 1,247,328 | A | | 11/1917 | Reams | |
| 1,321,625 | A | * | 11/1919 | Grover | 7/138 |
| 1,402,434 | A | | 1/1922 | Morse | |
| 2,091,538 | A | * | 8/1937 | Wasseth | 30/506 |
| 4,509,784 | A | | 4/1985 | Vollers | |
| D292,549 | S | | 11/1987 | Rixen | |
| 5,146,815 | A | | 9/1992 | Scott, III | |
| 5,303,439 | A | * | 4/1994 | Seals | 7/138 |
| 5,544,379 | A | * | 8/1996 | Chen | 7/138 |
| 5,652,988 | A | * | 8/1997 | Appelhoff | 7/151 |
| 5,655,242 | A | * | 8/1997 | Chuang | 7/138 |
| 5,673,976 | A | * | 10/1997 | Hillis et al. | 301/58 |
| 5,894,767 | A | | 4/1999 | Wridt et al. | |
| D417,372 | S | * | 12/1999 | Cachot | D8/17 |
| 6,336,385 | B1 | * | 1/2002 | Wang | 81/177.4 |
| D467,777 | S | | 12/2002 | Van Horn et al. | |
| 6,557,946 | B1 | | 5/2003 | Gerrit et al. | |
| 6,574,817 | B1 | * | 6/2003 | Wu | 7/138 |
| 6,622,329 | B1 | * | 9/2003 | Ostor et al. | 7/138 |
| 6,679,142 | B1 | * | 1/2004 | Lin | 81/437 |

FOREIGN PATENT DOCUMENTS

| | | |
|---|---|---|
| JP | 10-235567 | 9/1998 |

* cited by examiner

*Primary Examiner*—Joseph J. Hail, III
*Assistant Examiner*—Alvin J. Grant
(74) *Attorney, Agent, or Firm*—David C. Brezina; Barnes & Thornburg LLP

(57) ABSTRACT

A bladed spoke wrench device used to retain the orientation of a bladed bicycle spoke to prevent unnecessary torsional displacements from being applied to the spoke during spoke tensioning and adjustment. The bladed spoke wrench includes two spoke retention slots of different widths to accommodate the most common bladed spoke thicknesses. The spoke retention slots extend both through the thickness of the tool on both sides and along one face of the tool, allowing the user to orient the tool in any of several ways that the user finds comfortable and efficient during use. The tool also includes one or more hook shaped areas that are adapted to open a bottle and further includes an opening at one end that defines a ring useful for attachment of the bladed spoke wrench to a peg on a tool board, a key ring or other hook.

10 Claims, 2 Drawing Sheets

BLADED SPOKE WRENCH

BACKGROUND

This disclosure relates to a bladed spoke wrench that is designed to maintain the orientation of bladed spokes when adjustments are made during the assembly or truing bladed spoke bicycle wheels.

Bladed spokes are used in some bicycle wheels to reduce aerodynamic drag, thus reducing the resistance to forward motion. Wind tunnel studies, as well as theoretical calculations show that bladed spokes permit a bike to go faster for the same power input than round spokes due to the reduction in aerodynamic drag. Another way to reduce aerodynamic drag in a spoked wheel is to reduce the number of spokes used in the wheel design. Simply reducing the number of spokes reduces the load carrying capacity of a wheel. To compensate, changes can be undertaken to increase the load carrying capacity of the wheel. One design change to increase load capacity is to utilize a heavier, stiffer rim. Another is to increase spoke tension. In order to reduce weight, some bladed spokes are made from thinner wire.

One drawback to bladed spokes over conventional round spokes is that they are torsionally more flexible than round spokes of equal cross sectional area. Spokes are placed under torsional loads when the technician is adjusting the spoke nipple during wheel assembly or subsequent truing. Bicycle wheel designs with fewer spokes are often under considerably higher spoke tensions and are also under increased torsional stress during spoke adjustment. This torsional flexibility is inconvenient when truing the wheel, since the technician must turn the spoke wrench, not only to adjust the spoke nipple, but to cover the elastic wind up in the flexible spoke. These torsional stresses, when combined with the tensile stresses in a tension spoke, may exceed the yield strength of the spoke, especially spokes made from thinner wire. Unless the torsional stress or the tensile stress within the spoke is controlled, some spokes may yield and permanently take on a spiral set when adjusted without using means for holding the bladed spoke. In order to control torsional loads during adjustment, tools having serrated jaws such as pliers, are sometimes used. These tools can mar or scratch spokes. Such tools are also less convenient to carry and handle.

In view of the above, it should be appreciated that there is a need for a bladed spoke wrench that limits excessive torsional loads on bladed bicycle spokes, to prevent permanent damage to the spokes from occurring and that is convenient to use. The present disclosure satisfies these and other needs and provides further related advantages.

SUMMARY

The disclosure includes a bladed spoke wrench device used to retain the orientation of a bladed bicycle spoke and to prevent unnecessary torsional loads from being applied to the spoke during spoke tensioning and adjustment. The bladed spoke wrench includes two spoke retention slots of different widths to accommodate the most common bladed spoke thicknesses. The spoke retention slots extend both through the thickness of the tool on both sides and along one face of the tool, allowing the user to orient the tool in any of several ways that the user finds comfortable and efficient during use. The bladed spoke wrench also includes a square or a diamond shaped opening at one end that is dimensioned to fit popular spoke nipples, so that the bladed spoke wrench can be used to turn the spoke nipple during wheel adjustment or assembly. The tool also includes two hook shaped areas that are adapted to open a bottle and further includes an opening at one end that defines a ring useful for attachment of the bladed spoke wrench to a peg on a tool board, a key ring or other hook. The bladed spoke wrench is flat and elliptically shaped so that the tool fits comfortably in the user's hand. The bladed spoke wrench also includes a centralized recession that is adapted to permit the application of a branded logo or other decoration. The bladed spoke wrench, when used in the adjustment of bladed bicycle spokes, prevents unwanted torsional loads and torsional displacements from being applied to the spoke during wheel assembly or subsequent truing.

Other features and advantages of the disclosure will be set forth in part in the description which follows in the accompanying drawings, wherein the embodiments of the disclosure are described and shown, and in part will become apparent upon examination of the following detailed description taken in conjunction with the accompanying drawings.

DETAILED DESCRIPTION

Figure 1:
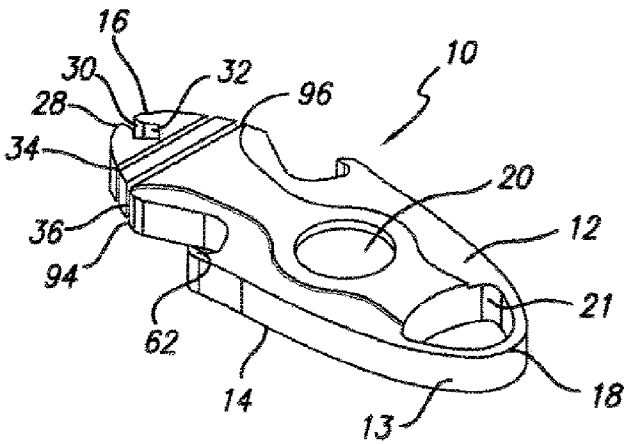
FIG. 1 is a perspective view of the bladed spoke wrench.
Figure 4:
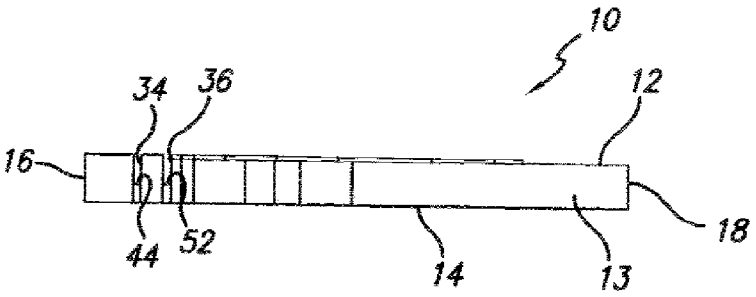
FIG. 4 is a side view of the bladed spoke wrench.

As illustrated in the drawings, a bladed spoke wrench 10, as shown in FIG. 1, is designed to maintain the orientation of a bladed spoke during wheel assembly or subsequent truing, to prevent torsional loads from being applied to the bicycle spoke.

The typical bicycle wheel is composed of a rim suspended with tensioned spokes around a center hub. Each spoke pulls on a section of rim. Spokes coming from the right side of the hub pull the rim to the right. Spokes coming from the left side of the hub pull the rim to the left. Having all the spokes tight with fairly even tension makes the wheel true and strong. Changes to spoke tension will pull on the rim and affect its true. This process is called "truing".

Truing is occasionally needed to keep the rim running straight as it spins between the brake pads. Spoke tension is adjusted by tightening or loosening a threaded nut, called the nipple, at the end of the spoke. Spoke threads typically use right-hand threads. Although a common phrase among mechanics is to "tighten the spokes", it is the nipple that is turned, not the spokes. Turning of the spokes creates a torsional force in the spokes since only the nipple turns.

To adjust tension at the nipple, a wrench must be applied to the nipple. It is important that the spoke nipple wrench is fully engaged on the nipple before turning. A wrench that is partially engaged may damage the nipple and make truing difficult.

Spokes and nipples should be considered "fasteners", like any nut and bolt. Spokes have an elongated shaft portion and have threads at one end and a spoke head at the other. The elongated shaft portion can be either round for general bikes or flat (bladed) for racing applications. Generally, spokes should be as tight as the wheel allows. Too low of spoke tension tends to decrease the wheel's load bearing capacity.

Too high of tension may damage the rim or hub by pulling too much. The rim may develop cracks where the nipple exits the rim, or the hub flange may crack. Spoke tension is best measured with a spoke tension meter (also called a tensiometer).

There are some models of wheels where the nipple is located at the hub. These wheels true the same as conventional wheels. Tightening a spoke will draw the rim toward the hub side where it connects. If the wheel has flat bladed spokes, it is often necessary to hold the spoke flat close to the nipple with an adjustable wrench to keep the spoke from twisting. The use of an adjustable wrench or pliers can mar bladed spokes, ruining their finish and possibly weakening the spoke.

As shown in the exemplary drawings, with particular reference to FIG. 1, the bladed spoke wrench 10 is relatively flat, having a top surface 12 and a spaced apart bottom surface 14. The bladed spoke wrench 10 has a generally elliptical perimeter 13, with a forward end 16 and a spaced apart rearward end 18. While the preferred shape of the bladed spoke wrench 10 is elliptical or oval, other shapes for the wrench 10 are also contemplated, including tear dropped, circular or rectangular, among others. Elliptical is preferred in that it fits comfortably in the user's hand. The top surface 12 of the bladed spoke wrench 10 is relatively planar and includes a centralized recession 20 that is adapted to receive a branded logo or other decoration. The recession 20 protects the logo from unintended wear or scratching. The top surface 12 also includes a D-shaped aperture 21 located at the rearward end 18 of the bladed spoke wrench 10 that extends from the top surface 12 through the bladed spoke wrench 10 to the bottom surface 14. The aperture 21 is adapted to permit the bladed spoke wrench 10 to be attached to a peg on a tool board or similar hook or placed on a key ring so that the bladed spoke wrench 10 is readily available for usage. Other shapes are also possible.

The bladed spoke wrench 10 is preferably manufactured from aluminum or steel, but it is contemplated that the wrench can be made from other materials, including plastics and various metal alloys. The material in which the bladed spoke wrench 10 is manufactured from is limited by the tool's ability to maintain its shape when force is applied to the bladed spokes or nipples of the bicycle rim.

Figure 2:
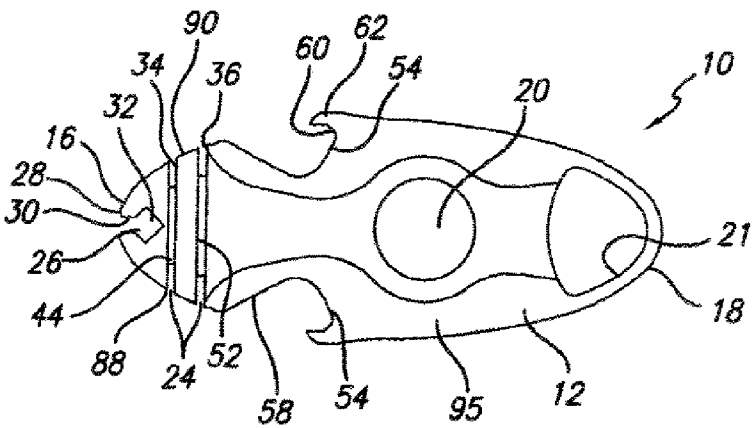
FIG. 2 is a top view of the bladed spoke wrench.

The forward end 16 of the bladed spoke wrench 10 includes a pair of bladed spoke retention slots 24 and a nipple opening 26, as shown in FIG. 2. The nipple opening 26 is formed at the leading edge 28 of the forward end 16 of the bladed spoke wrench 10 and is adapted to engage and rotate a bicycle spoke nipple. The nipple opening 26 includes a passageway 30 which leads to a recess 32 that is adapted to engage the bicycle spoke nipple. While the recess 32 of the bladed spoke wrench 10 is square in shape, other shapes are contemplated that conform to the exterior dimensions of the various bicycle spoke nipples to be adjusted. The nipple opening 26 of the bladed spoke wrench 10 is positioned at the leading edge 28 to permit accessibility to the spoke nipples and allow for the greatest range of arcuate movement.

The forward end 16 of the bladed spoke wrench 10 further includes a pair of bladed spoke retention slots 24 as shown in FIG. 2. This includes a first retention slot 34 and a second retention slot 36. The first retention slot 34 is positioned closest to the forward end 16 of the bladed spoke wrench 10. The first retention slot 34 is open along the top surface. The first retention slot 34 also includes a bottom wall portion 44. The bottom wall 44 is adapted to retain the leading edge 28 to the bladed spoke wrench 10 and also serves as a surface for engaging the bladed spokes. The first retention slot 34 is open along the top surface 12 in order to allow the user to retain the spokes at various tool positions to provide greater spoke access.

The second retention slot 36 of the bladed spoke wrench 10 is also open along the top surface 12. The second retention slot also includes a bottom wall 52 that is adapted to engage the surface of the bicycle spoke. The second retention slot 36 has a width that varies from the width of the first retention slot so that the bladed spoke wrench 10 can be utilized for various spoke sizes. The second retention slot 36 is open along the top surface 12 to allow the bladed spoke wrench 10 be positioned at various angles to permit proper engagement with the bicycle spokes. While two retention slots 34, 36 are shown, it is contemplated that more slots may be positioned along the bladed spoke wrench 10 to accommodate spokes of varying dimensions. It is also contemplated that one or more of the retention slots may be positioned on the bottom surface 14 of the bladed spoke wrench 10 or that more than one nipple opening 26 may be provided to accommodate various sized bicycle spoke nipples. The first spoke retention slot 34 of the bladed spoke wrench 10 includes a first slot 88 located along the perimeter edge 13 of the body portion 95 of the bladed spoke wrench 10, as shown in FIG. 2. The first slot 88 of the bladed spoke wrench 10 is in communication with the first spoke retention slot 34 in that the gap between the first spoke retention slot and the first slot 88 are uninterrupted. The first slot 88 extends from the top surface 12 to the bottom surface 14 along the perimeter edge 13. The first spoke retention slot 34 of the bladed spoke wrench also includes a second slot 90 that is located along the perimeter edge 13 and opposes the first slot 88. The second slot 90 also extends from the top surface 12 through to the bottom surface 14 along the perimeter edge 13. The second slot 90 of the bladed spoke wrench 10 is also in communication with the first spoke retention slot 34 in that the gap between the first spoke retention slot and the second slot 90 are uninterrupted.

Figure 3:
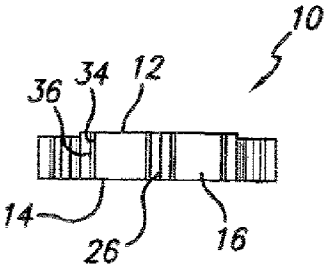
FIG. 3 is a front view of the bladed spoke wrench.

The second spoke retention slot 36 of the bladed spoke wrench 10 includes a third slot 94 located along the perimeter edge 13 of the body portion of the bladed spoke wrench 10, as shown in FIG. 3. The third slot 94 of the bladed spoke wrench 10 is in communication with the second spoke retention slot 36 in that the opening of the second spoke retention slot 36 and the third slot 94 are continuous. The continuous slots permits the user to use the either the second spoke retention slot 36 or the third slot 94 of the bladed spoke wrench 10, depending upon the user's preference or spacing restrictions between the bladed spokes. The third slot 94 extends from the top surface 12 to the bottom surface 14 along the perimeter edge 13. The second spoke retention slot 36 of the bladed spoke wrench 10 also includes a fourth slot 96 that is located along the perimeter edge 13 and opposes the third slot 94. The fourth slot 96 also extends from the top surface 12 through to the bottom surface 14 along the perimeter edge 92. The fourth slot 96 of the bladed spoke wrench 10 is also in communication with the second spoke retention slot 36 in that the gap between the second spoke retention slot 96 and the fourth slot 96 are uninterrupted. The interconnected gaps of the various slots permits the bladed spoke wrench 10 to either have the top surface 12 oriented towards the bladed spoke, allowing the first or second spoke retention slots 34, 36 to be used or can have the perimeter edge 13 oriented towards the bladed spoke so that the first, second, third or fourth slots can be used to retain the spoke to lessen the torsional forces applied to the spoke while adjusting the spoke nipple. Also, if two bladed spoke wrenches 10 are used, one can be used to retain the position of the bladed spoke and the other can be used to rotate the spoke nipple to true the wheel.

The bladed spoke wrench also includes a pair of recesses 54, as shown in FIG. 2, positioned along the sidewalls 56 of the bladed spoke wrench 10. The recesses 54 of the bladed spoke wrench 10 include sloped wall portions 58 followed by a curved bottom wall 60. The side walls 56 further include tabs 62 having an orientation that is adapted to engage and remove the pressed cap of a bottle.

Figure 6:
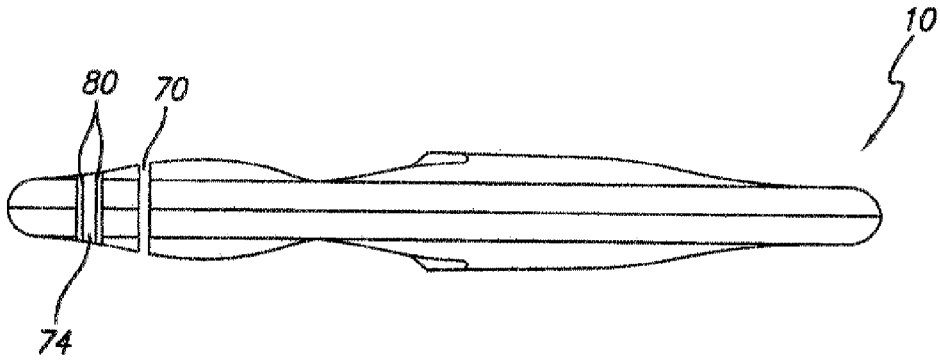
FIG. 6 is a side elevational view of the alternate embodiment of the bladed spoke wrench.
Figure 5:
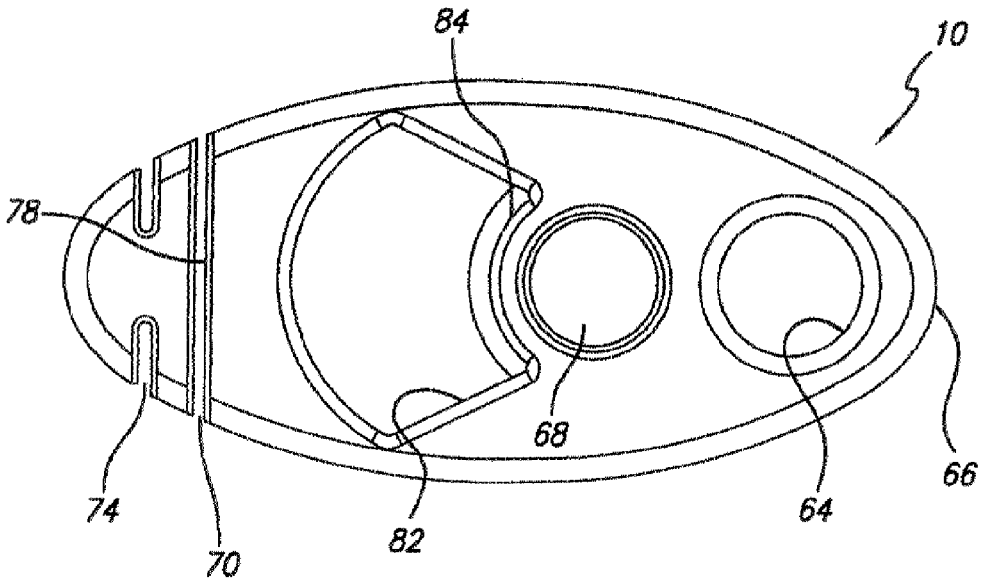
FIG. 5 is a top view of an alternate embodiment of the bladed spoke wrench.

FIGS. 5 and 6 illustrate another embodiment of the bladed spoke wrench 10 that includes an opening 64 located at the rearward end 66 of the bladed spoke wrench 10. The bladed spoke wrench further includes a recess 68 adapted to accept a branded logo or other decoration. The bladed spoke wrench 10, as shown in FIGS. 5 and 6, include a first retention slot 70 in the top surface 72 and a second retention slot 74 in bottom surface 76 of the bladed spoke wrench 10. The first retention slot 70 includes a bottom wall 78 and the second retention slot 74 includes a bottom wall 80. The bottom walls 78 and 80 are adapted to engage the bladed spoke. One of the retention slots 70 is dimensionally narrower than the other retention slot to accommodate various spoke thicknesses. The bladed spoke wrench further includes an arcuate aperture 82 positioned adjacent to the recess 68. The arcuate recess 82 includes an arcuate lip 84 that is positioned along a wall 86 of the aperture 82. The arcuate aperture 82 in combination with the lip 84 of the bladed spoke wrench 10 permits the wrench to be used to remove the caps from bottles. Also, shapes other than arcuate are anticipated.

Various features of the invention have been particularly shown and described in connection with the disclosure as shown and described. However, it must be understood that these particular arrangements merely illustrate, and that the disclosure is to be given its fullest interpretation within the terms of the appended claims.

What is claimed is:

1. A bladed spoke wrench for retaining the orientation of bladed spokes during wheel maintenance and assembly, the bladed spoke wrench comprising:

a wrench body having a top surface, a bottom surface and one or more peripheral side walls interconnecting the top and bottom surfaces, wherein the wrench body includes a recess in the peripheral side wall, the recess having a sloped wall portion and a tab, the recess adapted to permit the opening of bottle tops;

at least one spoke retention slot extending across one of the surfaces and extending around and forming at least one side wall slot in the peripheral side wall, the spoke retention slot adapted to engage and retain the orientation of the bladed wheel spokes;

a bottom wall positioned within the at least one spoke retention slot, the bottom wall adapted to engage a portion of the bladed wheel spokes;

wherein the at least one spoke retention slot or the at least one side wall slot retain the orientation of the bladed spoke during wheel maintenance and assembly.

2. A bladed spoke wrench for retaining the orientation of bladed wheel spokes during wheel maintenance and assembly, the bladed spoke wrench comprising:

a wrench body having a top surface and a spaced apart bottom surface interconnected by a peripheral edge;

a first spoke retention slot extending along one of the surfaces, the first spoke retention slot adapted to engage and retain the orientation of the bladed wheel spokes;

a second spoke retention slot in communication with the first spoke retention slot, the second spoke retention slot extending from the top surface to the bottom surface through the peripheral edge and adapted to engage and retain the orientation of the bladed wheel spokes;

wherein the first spoke retention slot and the second spoke retention slots can each be used to retain the orientation of the blade wheel spoke during wheel maintenance and assembly; and a third spoke retention slot extending along one of the surfaces, the third spoke retention slot having a width greater or less than the first spoke retention slot and adapted to engage and retain the orientation of the bladed wheel spokes.

3. The bladed spoke wrench of claim 2, further including a fourth spoke retention slot in the communication with the third spoke retention slot, the fourth spoke retention slot extending form the top surface to the bottom surface through the peripheral edge and adapted to engage and retain the orientation of the bladed wheel spokes.

4. The bladed spoke wrench of claim 2, wherein the first spoke retention slot extends across the top surface and the third spoke retention slot extends across the bottom surface.

5. A bladed spoke wrench for retaining the orientation of bladed wheel spokes during wheel maintenance and assembly, the bladed spoke wrench comprising:

a wrench body having a top surface and a spaced apart bottom surface interconnected by a peripheral edge;

a first spoke retention slot extending along one of the surfaces, the first spoke retention slot adapted to engage and retain the orientation of the bladed wheel spokes;

a second spoke retention slot in communication with the first spoke retention slot, the second spoke retention slot extending from the top surface to the bottom surface through the peripheral edge and is adapted to engage and retain the orientation of the bladed wheel spokes;

a third spoke retention slot extending along one of the surfaces and having width that varies from the first and second spoke retention slots, the third spoke retention slot adapted to engage and retain the orientation of the bladed wheel spokes;

a fourth spoke retention slot in communication with and having a width equal to the third spoke retention slot, the fourth spoke retention sot extending from the top surface to the bottom surface through the peripheral edge and is adapted to engage and retain the orientation of the bladed wheel spokes;

wherein the spoke retention slots can independently be used to retain the orientation of the blade wheel spokes during wheel maintenance and assembly.

6. The bladed spoke wrench of claim 5, wherein the wrench body includes an aperture extending from the top surface to the bottom surface, the aperture adapted to permit suspension of the bladed spoke wrench.

7. The bladed spoke wrench of claim 5, wherein the wrench body includes a spoke nipple recess located at one end adapted to engage and permit rotation of a bicycle spoke nipple.

8. The bladed spoke wrench of claim 5, wherein the wrench body includes a recess in the peripheral side wall, the recess having a sloped wall portion and a tab, the recess adapted to permit the openings of bottle tops.

9. The bladed spoke wrench of claim 5, wherein the first spoke retention slot extends across the top surface and the third spoke retention slot extends across the bottom surface.

10. The bladed spoke wrench of claim 5, wherein the wrench body includes an arcuate opening extending from the top surface to the bottom surface, the arcuate opening including a lip adapted to engage a bottle cap to permit removal of the bottle cap from a bottle.

* * * * *